United States Patent [19]

Kelly

[11] Patent Number: 4,608,805

[45] Date of Patent: Sep. 2, 1986

[54] SCREWCAPPING MACHINE

[75] Inventor: Frank M. Kelly, Richmond, Ind.

[73] Assignee: Aluminum Company of America, Pittsburgh, Pa.

[21] Appl. No.: 792,502

[22] Filed: Oct. 29, 1985

[51] Int. Cl.[4] ..... B67B 3/20; B65B 7/28

[52] U.S. Cl. ..... 53/308; 53/317; 53/331.5

[58] Field of Search ..... 53/308, 306, 317, 331.5

[56] References Cited

U.S. PATENT DOCUMENTS

| | | | |
|---|---|---|---|
| 1,888,470 | 11/1932 | Risser | 53/306 X |
| 2,884,751 | 5/1959 | Bjering | 53/317 |
| 3,242,632 | 3/1966 | Dimond | 53/67 |
| 3,309,838 | 3/1967 | Wilhere | 53/306 X |
| 3,491,516 | 1/1970 | Bergeron | 53/317 |
| 3,537,231 | 11/1970 | Dimond | 53/201 |
| 3,955,341 | 5/1976 | Wilhere | 53/317 X |
| 3,964,240 | 6/1976 | Evrard | 53/306 |
| 4,364,218 | 12/1982 | Obrist | 53/331.5 |
| 4,492,068 | 1/1985 | Obrist | 53/331.5 |
| 4,535,583 | 8/1985 | Tanaka et al. | 53/317 X |

*Primary Examiner*—Horace M. Culver

*Attorney, Agent, or Firm*—Thomas J. Connelly

[57] ABSTRACT

A screwcapping machine for screwing a screw closure onto a prethreaded container. The screwcapping machine includes a housing fixed to a stationary support shaft and has a pair of drive motors for independently rotating the turret and the spindles about their own axis. The housing also has a cam which is traversed by a cam follower attached to each spindle which causes the respective spindle to reciprocate. The screwcapping machine further includes a positioning means for selectively orienting the screw closure relative to one of the screwcapping heads when the respective spindle is in a predetermined position and control means for actuating the screwcapping heads to enable the head to grasp the screw closure and tighten it onto the container.

9 Claims, 5 Drawing Figures

Fig. 1
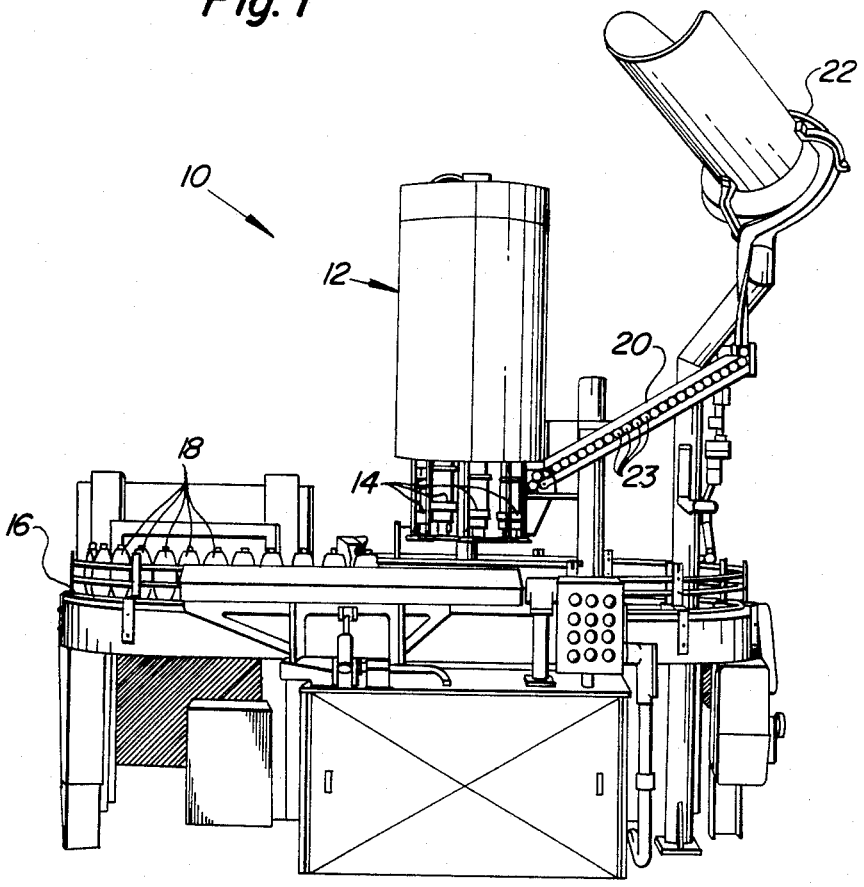
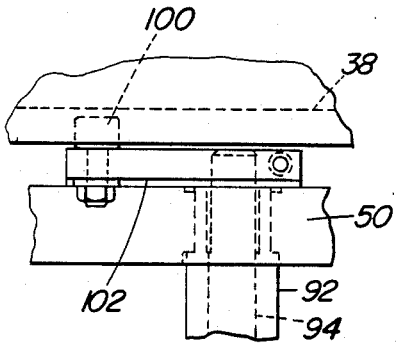
Fig. 3

64
78
58
122
124
56
128
130
80
60
62
72
70
52
54
48
74
50
92
76
38
32
36
34
100
40
102

SCREWCAPPING MACHINE

FIELD OF THE INVENTION

This invention relates to a screwcapping machine for screwing prethreaded closures onto containers provided with a screw thread.

BACKGROUND OF THE INVENTION

There are various forms of screwcapping machines on the market today which are designed to screw closures onto a series of containers which are sequentially advanced through the machine. Three such screwcapping machines are taught in U.S. Pat. Nos. 3,242,632; 3,491,516; and 3,537,231. In turret-type machines, a plurality of screwcapping heads are arranged in a circular fashion and are selectively brought into alignment with a container which is to be capped. With these types of machines, one must consider the weight of the screwcapping heads in relation to their rotational speed. The reason for this is that the inertia of a heavier screwcapping head rotating about its own axis produces a certain torque which varies with the square of the speed. A light screwcapping head therefore encounters less inertia. This factor is important because a screwcapping machine is normally set for one preferred line speed at which the closures are torqued at a predetermined value onto the containers. Due to common line problems, it becomes necessary for the operator to vary the speed of the screwcapping machine to accommodate different size containers, different weight containers, containers having a different number of screw threads, etc. Such action affects the torque at which the closures are threaded onto the containers.

With the advent of screwcapping heads having magnetic clutches, such as is taught in U.S. Pat. Nos. 4,364,218 and 4,492,068 and in allowed U.S. Ser. No. 602,237, filed Apr. 19, 1984, and assigned to Aluminum Company of America, the weight of the screwcapping heads has increased significantly. Now the torque on the screwcapping head is determined by two factors, one being the magnetic torque of the clutch assembly, which is a constant, and the second being the inertia torque of the head itself. Up until now, manufacturers have had to sacrifice screwing a closure onto a container at a preferred torque value when the line speed of the containers, relative to the turret speed, varied. Now a screwcapping machine has been invented which overcomes this problem and permits the screwcapping head to be rotated at a constant speed regardless of the speed of the turret or the line speed of the containers. Also, the weight of the screwcapping head is no longer so critical. In this way, tightening torque on the cap remains constant because the two factors controlling torque remain constant. These two factors are the clutch setting and the rotational speed of the capping head.

SUMMARY OF THE INVENTION

Briefly, this invention relates to a screwcapping machine which is designed to screw prethreaded closures onto containers provided with a screw thread. The screwcapping machine includes a housing coaxially aligned with and fitted to a stationary support shaft. The housing has a pair of cams formed on an inner surface thereof. A turret is rotatably mounted on the support shaft and is partially enclosed by the housing. A plurality of spindles are retained by the turret and are radially aligned in a circular fashion about the support shaft. Each of the spindles has a screwcapping head attached to an end thereof. A first variable speed motor is connected to the turret for revolving the turret about the support shaft and a second variable speed motor is connected to the spindles for independently rotating the spindles about their own axis. By separating controlling the speed of each spindle, the torque used to apply a screw closure onto a prethreaded container can be finally adjusted.

Each of the spindles has a cam follower securely fixed to it which is in rolling contact with one of the cams formed on the housing. Movement of each of the cam followers about the cam causes each respective spindle to reciprocate with respect to the housing. This permits each screwcapping head to be lowered and raised relative to alignment with a container which is to be capped. A pick-off mechanism is secured to the turret and is movable by a cam follower in contact with the second cam formed on the housing. The pick-off mechanism includes a swingable arm and a pick-off button, attached to an end thereof, which selectively orients a prethreaded closure relative to one of the screwcapping heads when the respective spindle is in a predetermined position. Lastly, the screwcapping machine contains a control for actuating the screwcapping heads to enable the heads to grasp a prethreaded closure from the pick-off mechanism and to screw it onto a prethreaded container. After the closure has been screwed onto the container at a predetermined torque value, the screwcapping head will release the closure and move upward out of the way so as to be in position to repeat the cycle.

The general object of this invention is to provide a screwcapping machine. A more specific object of this invention is to provide a screwcapping machine which will screw prethreaded closures onto containers provided with screw threads.

Another object of this invention is to provide a screwcapping machine having an independent drive motor for the turret and an independent drive motor for the spindles.

Still further, another object of this invention is to provide a screwcapping machine which will permit the use of heavier screwcapping heads while providing adequate torque for torqueing a closure onto a prethreaded container regardless of line speed.

A further object of this invention is to provide a screwcapping machine which is simple in construction, economical to build, easy to maintain and which uses a pair of variable drive motors to drive the turret and the spindles so that changes in the turret speed will not affect the available torque present at the screwcapping heads.

Other objects and advantages of the present invention will become more apparent to those skilled in the art in view of the following description and the accompanying drawings.

BRIEF DESCRIPTION OF THE DRAWINGS

FIG. 1 is an assembly view of a screwcapping machine showing a turret assembly with eight screwcapping heads, a conveyor for transporting containers and a feed mechanism for supplying prethreaded closures.

FIG. 3 is a side view of the cam follower and pick-off arm shown in FIG. 2.

DETAILED DESCRIPTION OF THE PREFERRED EMBODIMENT

Figure 2A:
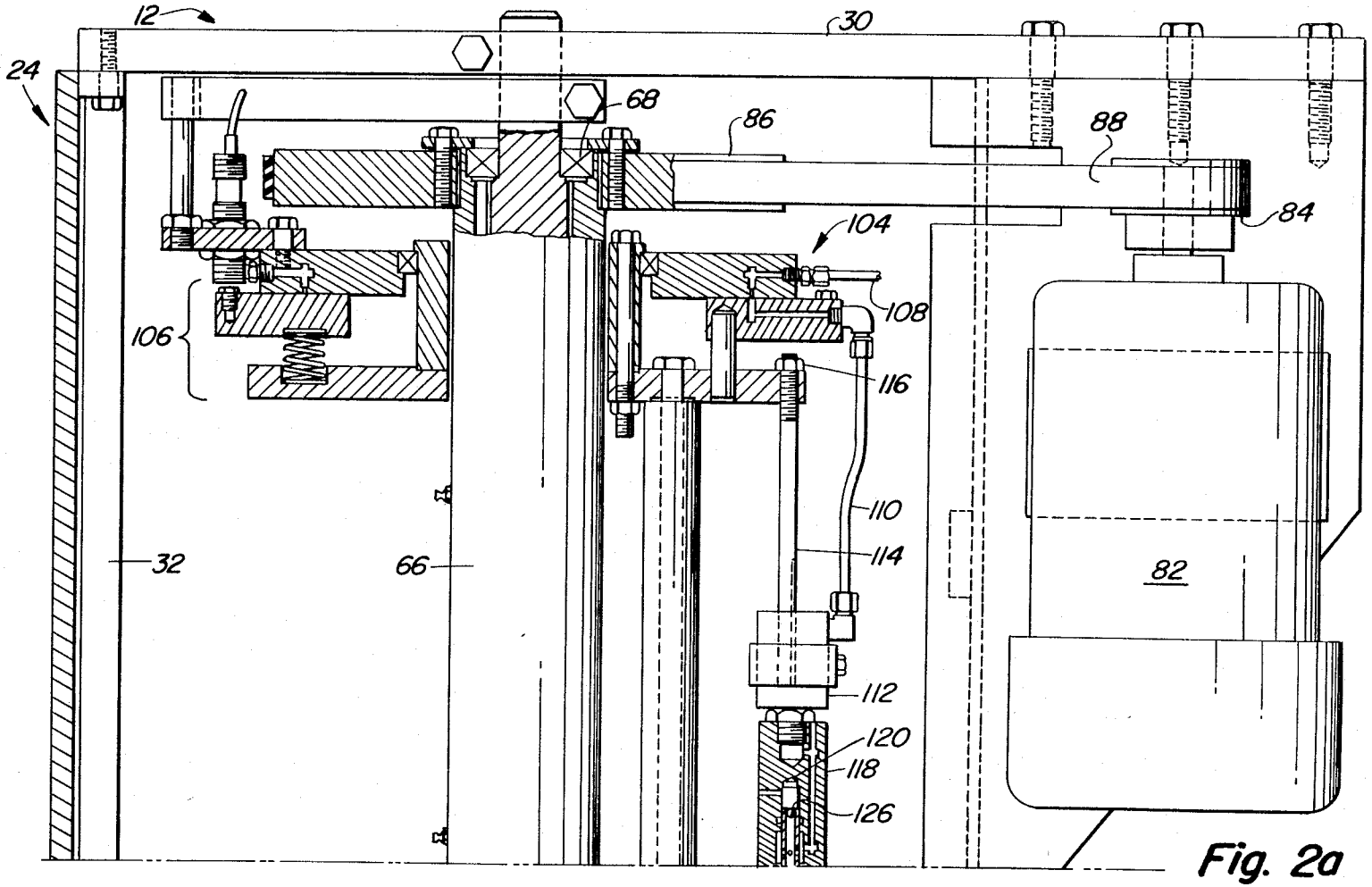
FIGS. 2*a, b* and *c* are cross-sectional views of the turret asembly shown in FIG. 1.
Figure 2B:
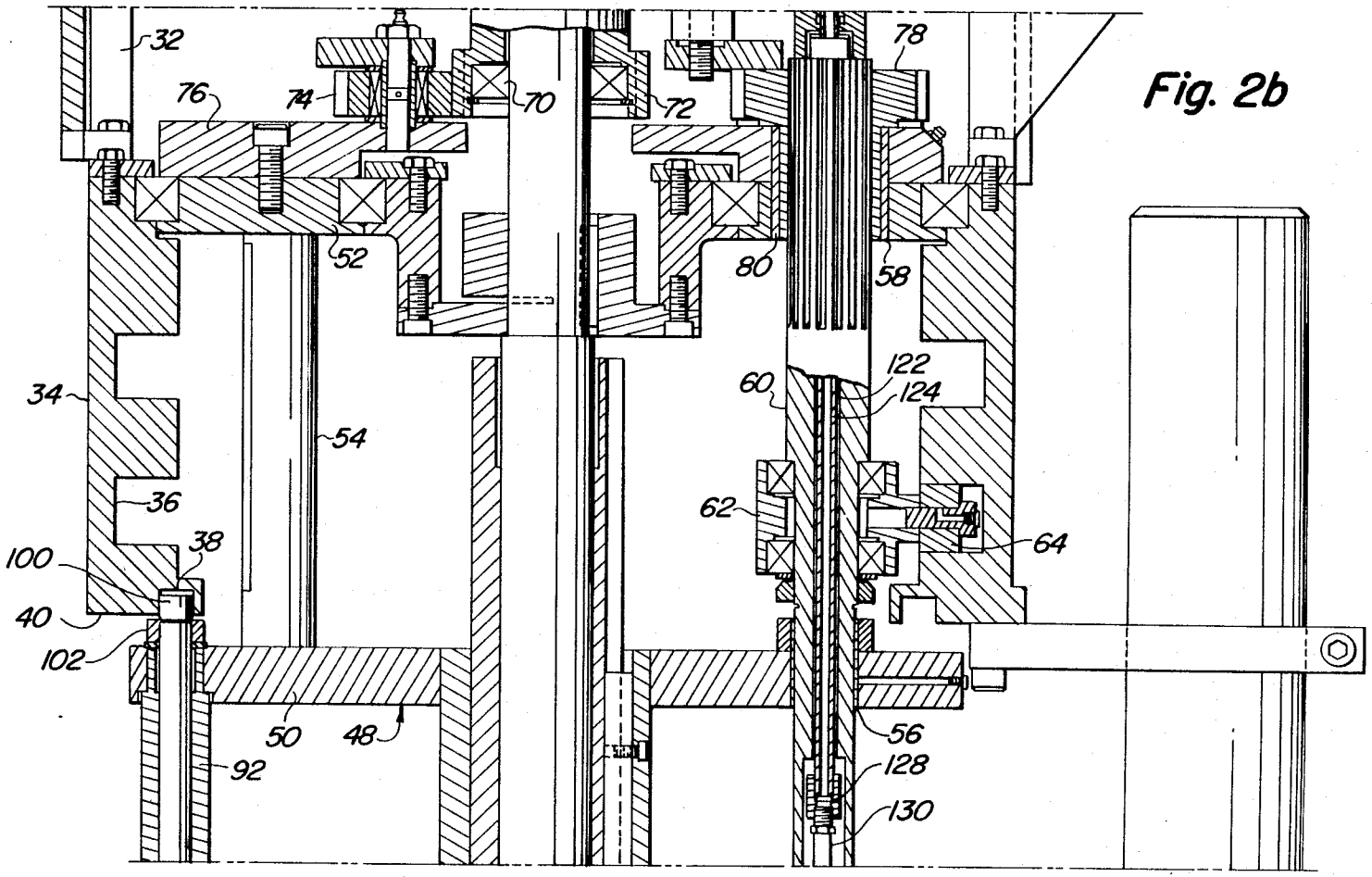
Figure 2C:
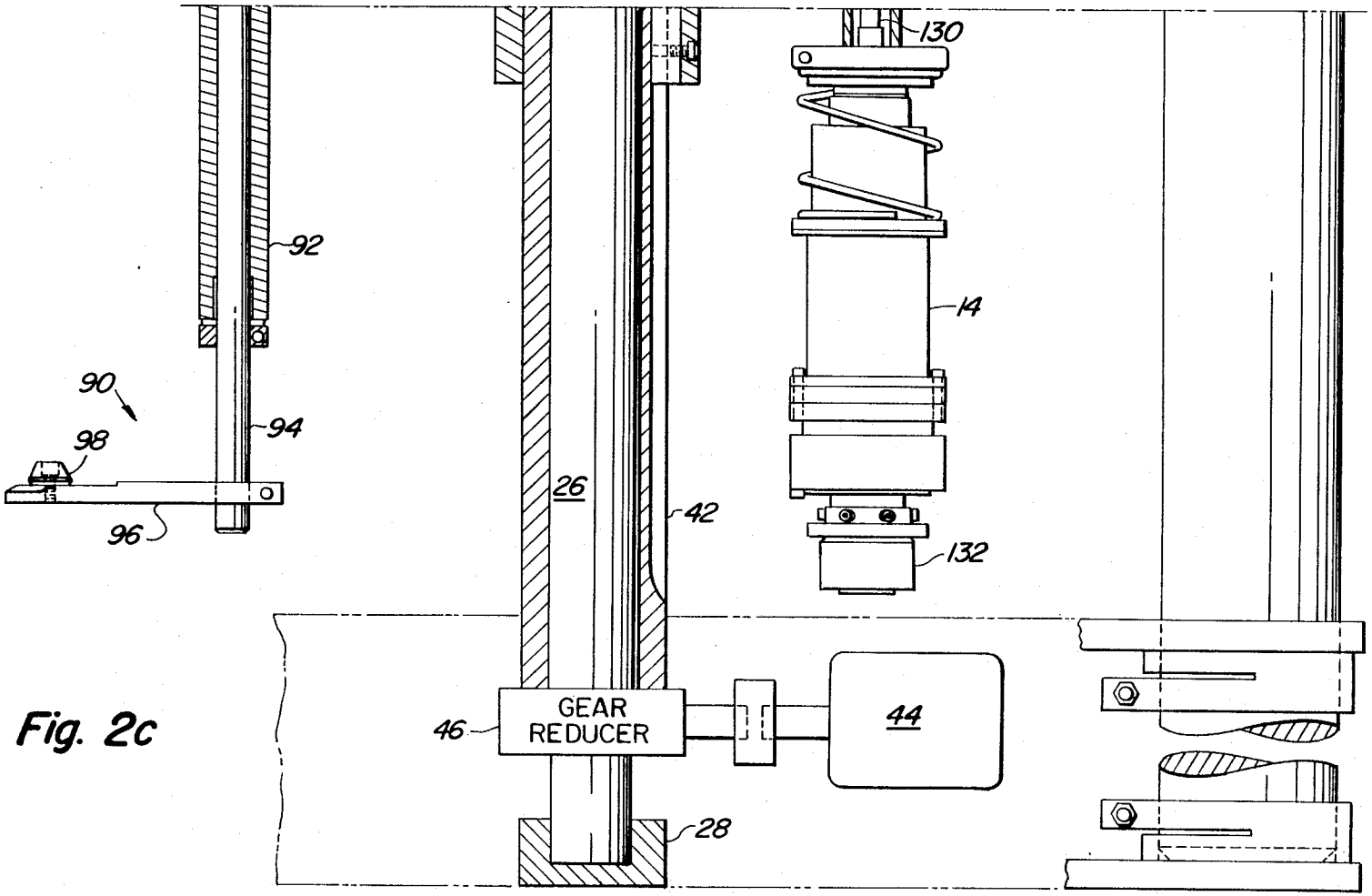

Referring to FIG. 1, a screwcapping machine 10 is shown having a turret assembly 12. The turret assembly 12 houses a plurality of screwcapping heads 14 arranged in a circular fashion above a conveyor 16 which transports prethreaded containers 18. A feed mechanism 20 connected to a hopper 22 routes screw closures 23 to the screwcapping heads 14.

Referring to FIGS. *2a, b* and *c*, the turret assembly 12 includes a housing 24 coaxially aligned with and secured to a stationary support shaft 26. The support shaft 26 is secured to a support block 28 so as to permit the screwcapping machine 10 to be positioned on the floor in an upstanding position or to be positioned on a table or counter. The housing 24 includes a top plate 30 securely fixed to an upper end of the support shaft 26, and a downwardly depending, circular sidewall 32 securely attached to the top wall 30. Attached to a lower portion of the sidewall 32 is a lower sidewall portion 34 which contains a first cam 36 formed on the inner peripheral surface thereof. A second cam 38 is formed in the bottom end 40 of the lower sidewall portion 34. The purpose of these two cams will be explained shortly.

A hollow sleeve 42 is coaxially aligned with and mounted to a lower section of the support shaft 26. The hollow sleeve 42 is attached to a first variable speed motor 44 via a gear reducer 46. The motor 44 and the gear reducer 46 enable the hollow sleeve 42 to rotate at a specific speed. Securely attached to an upper portion of the hollow sleeve 42 is a turret 48 which includes a lower plate 50 and an upper plate 52, both permanently connected by vertical supports 54. Both the lower and upper plates 50 and 52, respectively, contain a plurality of axially aligned apertures 56 and 58 through which spindles 60 are positioned. Commonly there are eight spindles arranged radially outward from the support shaft 26 in a circular fashion about the turret 48. However, any number of spindles can be used depending upon the size and application of the screwcapping machine 10. Attached to a lower end of each spindle 60 is a screwcapping head 14 which can include a magnetic clutch such as described in allowed U.S. Ser. No. 602,237, filed Apr. 19, 1984, and assigned to Aluminum Company of America. This patent application is incorporated by reference and made a part hereof. Attached to each of the spindles 60, between the lower plate 50 and upper plate 52, is a cam follower 62. The cam follower 62 includes rollers 64 which are in contact with the first cam 36. The rollers 64 move on the first cam 36 which is spiraled so as to cause the cam follower 62 to move up and down as it traverses the circumference thereof. This enables each of the spindles 60 to reciprocate relative to the turret 48.

The screwcapping machine 10 also includes a spindle drive housing 66 which is rotatably secured to an upper portion of the support shaft 26 by a pair of roller bearings 68 and 70. The lower portion of the spindle drive housing 66 contains a gear 72 which meshes with an idler gear 74 which in turn is rotatably secured to a support 76. The support 76 is securely fashioned to the upper plate 52. The idler gear 74 in turn meshes with a plurality of drive gears 78 which are attached to each of the spindles 60. Each drive gear 78 is held secured to the support 76 and to the upper plate 52 by a bushing 80. Rotational motion is imparted to the spindle drive housing 66 by a second variable speed motor 82 via a pair of pulleys 84 and 86 connected by a drive belt 88. The pulley 84 is connected to a shaft extending out of the motor 82 while the pulley 86 is mounted to the spindle drive housing 66. The second drive motor 82 permits power to be applied to each spindle 60 so as to rotate the spindles 60 at a predetermined speed independent of the speed of rotation of the turret 48.

The screwcapping machine 10 further includes a pick-off mechanism 90 for each spindle 60. The pick-off mechanism 90 is attached to the lower plate 50 and is positioned to the outside of the respective spindle 60. The pick-off mechanism 90 includes a downwardly depending housing 92 which is permanently attached to the lower plate 50 and through which is rotatably positioned a shaft 94. The lower end of the shaft 94 has an arm 96 perpendicularly secured thereto which contains a pick-off button 98. The pick-off button 98 has a configuration that permits each prethreaded closure 23 to be positioned thereon in the same orientation as is needed to be placed onto the container 18. That is, the closure 23 would be in an upright position with the top wall of the screw closure 23 located above the pick-off button 98 and the internal threads of the screw closure 23 contacting the sides of the pick-off button 98. The pick-off mechanism 90 is designed such that, after a screw closure 23 has been placed on the pick-off button 98, the arm 96 will swing into alignment below a raised screwcapping head 14 so as to permit the screwcapping head 14 to move vertically downward and grasp the closure 23. After the screw closure 23 is grasped, the screwcapping head 14 moves upward to allow the pick-off mechanism 90 to swing back out of the way so as to pick up another screw closure 23 for the next operation.

The pick-off mechanism 90 is capable of swinging into and out of alignment with its respective screwcapping head 14 by a cam arrangement. The cam arrangement, best shown in FIGS. *2b* and 3, includes a cam follower 100 rotatably secured to a cam arm 102 which in turn is secured to the shaft 94. The cam follower 100 contacts the second cam 38 formed on the housing 24. As is obvious to one skilled in the art, the cam 38 will be configured so that the reciprocal movement of the screwcapping heads 14 will be timed thereto and both will be adjusted to accommodate movement of the containers 18 along the conveyor 16.

The screwcapping machine 10 also contains a control mechanism 104 which actuates the screwcapping heads 14 so as to enable them to grasp the prethreaded closure 23 from the pick-off mechanism 90, to screw the closure 23 onto the container 18 and to release the screw closure 23 after it has been tightened onto the container 18. In FIG. *2a*, the control mechanism 104 is shown as an air distribution valve 106 connected by an air line 108 to a pressurized supply source (not shown). The air valve 106 is described in pending U.S. Ser. No. 792,500, filed Oct. 29, 1985, and assigned to Aluminum Company of America. This patent application is incorporated by reference and made a part hereof. Pressurized air from the air valve 106 is divided equally and is routed to each of the spindles 60 via a plurality of air hoses 110 and air unions 112. Each air union 112 is coaxially aligned with a respective spindle 60 and is supported by a rod 114. Each rod 114 is secured to the air valve 106 by a nut 116. The air union 112 is attached to the rod 114 in a manner which will allow for axial movement. This axial movement permits the screwcapping head 14 to reciprocate up and down approximately the same amount. Attached between the upper end of each spindle 60 and the lower end of the air union 112 is a sliding air valve 118 which has a central bore 120 formed therein. The central bore 120 is aligned with a longitudinal passageway 122 formed in each of the spindles 60. A hollow stem 124, having a smaller diameter than the passageway 122, is positioned therein and has a first end 126 which is received in the bore 120 of the sliding air valve 118 and a second end 128 which contacts an air hose 130. The air hose 130 connects the hollow stem 124 to the valving (not shown) within the screwcapping head 14. The screwcapping head 14 is described in pending U.S. Ser. No. 792,579, filed Oct. 29, 1985, and assigned to Aluminum Company of America and which is incorporated by reference and made a part hereof.

It should be noted that there is a space of approximately $\frac{1}{4}$–$\frac{1}{2}$ inch between the first end 126 of the hollow stem 124 and the base of the bore 120. This space provides clearance such that as the fingers 132, mounted on the end of the screwcapping head 14, surround and grip the screw closure 23, the top of the closure 23 will contact a member which is in axial contact with the air hose 130. Depending upon the skirt length of the closure 23, the air hose, which is connected directly to the hollow stem 124, will move upward to allow the closure 23 to be gripped correctly. Furthermore, for short closures, as the screwcapping head 14 moves vertically downward as the closure 23 is threaded onto the container 18, there will be a point where the closure 23 is completely threaded onto the container 18 before the screwcapping head 14 has moved completely down. In this situation, the space will permit the screwcapping head 14, the spindle 60 and the sliding air valve 118 to move downward along the closure 23 while the closure 23 and the hollow stem 124 remain stationary. The space therefore permits screw closures 23 of various heights, within a predetermined range, to be utilized by the screwcapping head 14 without the necessity of changing to a different size screwcapping head 14.

The control 104 is designed to route pressurized air to each of the screwcapping heads 14 so as to actuate the gripper fingers 132 between an open and a closed position. The shape of the cam 36 will dictate the amount of upward and downward movement of the screwcapping heads 14 at various degrees of rotation. The pressurized air entering each of the screwcapping heads 14 will be controlled by poppet valves so that the fingers 132 will open and close at predetermined times relative to the up and down position of the screwcapping heads 14. As is known to one skilled in the art, each of the screwcapping heads 14 will have the ability to pick the screw closure 23 off the pick-off mechanism 90 and move it upward and into alignment with the container 18. The respective screwcapping head 14 will then move vertically downward and tighten the screw closure 23 onto the container 18. After screwing the closure 23 onto the container 18, the screwcapping head 14 will release the closures 23 and move upward and over to its initial starting position.

By independently driving each of the spindles 60 at a predetermined speed, one can use a heavier screwcapping head 14, preferably one having a magnetic clutch, while still controlling the torque which is needed to screw the screw closure 23 onto the container 18. The independent drive motor also permits the closures 23 to be tightened onto the containers 18 at a faster speed.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A screwcapping machine comprising a housing having a cam formed on an inner surface thereof, a turret partially enclosed in said housing which retains a plurality of spindles each containing a cam follower which contacts said cam to impart reciprocal motion thereto, each of said spindles having a screwcapping head attached to an end thereof, drive means for independently rotating said turret relative to said housing and for rotating said spindles about their own axes and control means for actuating said screwcapping head to tighten a screw closure onto a prethreaded container at a desired torque value, said control means including a supply source of pressurized air, an air distribution valve fixed to said housing and fluidly connected to said supply source, a rotatable air union connected to each of said spindles, a first air hose connected between said air distribution valve and each of said air unions, a passageway formed longitudinally through each of said spindles and being in fluid communication with a pair of poppet valves located in said attached screwcapping head, said poppet valves being movably by said pressurized air to cause a chuck mounted on said screwcapping head to open and close so as to release and grasp said closure, respectively, each passageway housing a hollow stem having a first end which extends into a bore formed in said respective air union and having a predetermined axial clearance between said first end and an adjacent end of said bore, and a second end which contacts a second air hose which terminates in said screwcapping head, whereby as a screw closure is grasped by said screwcapping head and is lowered and tightened onto said container, said stem will move upward into said axial clearance to allow for further downward travel of said screwcapping head.

2. The screwcapping machine of claim 1 wherein said drive means are first and second variable speed motors.

3. The screwcapping machine of claim 1 wherein said screwcapping head contains a magnetic clutch.

4. A screwcapping machine comprising:

(a) a housing coaxially aligned with and fixed to a stationary support shaft, said housing having a cam formed on an inner surface thereof, (b) a turret rotatably mounted on said support shaft and partially enclosed by said housing, (c) a plurality of spindles retained by said turret and radially arranged about said support shaft, each of said spindles having a screwcapping head attached to an end thereof, (d) drive means for rotating said spindles about their own axes and for independently rotating said turret about said support shaft, (e) a cam follower securely fixed to each of said spindles and contacting said cam, movement of said cam follower about said cam causing said spindles to reciprocate with respect to said housing, (f) positioning means for selectively orienting a screw closure relative to one of said screwcapping heads when said respective spindle is in a predetermined position, and (g) control means for actuating said screwcapping heads to enable said heads to grasp said screw closure from said positioning means, tighten said screw closure onto a prethreaded container and release said screw closure after having tightened it onto said container, said control means including a supply source of pressurized air, an air distribution valve fixed to said housing and fluidly connected to said supply source, a rotatable air union connected to each of said spindles, a first air hose connected between said air distribution valve and each of said air unions, a passageway formed longitudinally through each of said spindles and being in fluid communication with a pair of poppet valves located in said attached screwcapping head, said poppet valves being movable by said pressurized air to cause a chuck mounted on said screwcapping head to open and close so as to release and grasp said closure, respectively, each passageway housing a hollow stem having a first end which extends into a bore formed in said respective air union and having a predetermined axial clearance between said first end and an adjacent end of said bore, and a second end which contacts a second air hose which terminates in said screwcapping head, whereby as a screw closure is grasped by said screwcapping head and is lowered and tightened onto said container, said stem will move upward into said axial clearance to allow for further downward travel of said screwcapping head.

5. The screwcapping machine of claim 4 wherein said drive means includes a first and a second drive motor, said first drive motor being connected to said turret and said second drive motor being connected to said spindles.

6. The screwcapping machine of claim 5 wherein said first and second drive motors are variable speed motors.

7. The screwcapping machine of claim 4 wherein said positioning means includes a pick-off mechanism secured to said turret and movable by a cam follower in contact with a second cam formed on said inner surface of said housing, said pick-off mechanism including a swingable arm and a pick-off button attached to an end of said cam.

8. The screwcapping machine of claim 7 wherein there is a pick-off mechanism for each screwcapping head.

9. A screwcapping machine for screwing a prethreaded closure onto a prethreaded container, said screwcapping machine comprising:

(a) a housing coaxially aligned with and secured to a stationary support shaft, said housing having a first and second cam formed on an inner peripheral surface thereof, (b) a turret rotatably mounted on said support shaft and partially enclosed by said housing, (c) a plurality of spindles retained by said turret and radially arranged in a circular fashion about said support shaft, each of said spindles having a screwcapping head attached to an end thereof, (d) a first variable speed motor connected to said turret for revolving said turret about said support shaft and within said housing, (e) a second variable speed motor connected to said spindles for independently rotating said spindles about their own axes, (f) a cam follower securely fixed to each of said spindles and in rolling contact with said first cam, movement of said cam follower about said cam causing said spindles to reciprocate with respect to said housing, (g) a pick-off mechanism secured to said turret and movable by a cam follower in contact with said second cam, said pick-off mechanism including a swingable arm and a pick-off button attached to an end of said arm which orients said closure relative to one of said screwcapping heads when said respective spindle is in a predetermined position, and (h) control means for actuating said screwcapping heads to enable said heads to grasp said closure from said pick-off mechanism, tighten said closure onto said container and release said closure after having tightened it onto said container, said control means including a supply source of pressurized air, an air distribution valve fixed to said housing and fluidly connected to said supply source, a rotatable air union connected to each of said spindles, a first air hose connected between said air distribution valve and each of said air unions, a passageway formed longitudinally through each of said spindles and being in fluid communication with a pair of poppet valves located in said attached screwcapping head, said poppet valves being movable by said pressurized air to cause a chuck mounted on said screwcapping head to open and close so as to release and grasp said closure, respectively, each passageway housing a hollow stem having a first end which extends into a bore formed in said respective air union and having a predetermined axial clearance between said first end and an adjacent end of said bore, and a second end which contacts a second air hose which terminates in said screwcapping head, whereby as a screw closure is grasped by said screwcapping head and is lowered and tightened onto said container, said stem will move upward into said axial clearance to allow for further downward travel of said screwcapping head.

* * * * *